United States Patent [19]

Hammer

[11] 4,373,663

[45] Feb. 15, 1983

[54] CONDITION CONTROL SYSTEM FOR EFFICIENT TRANSFER OF ENERGY TO AND FROM A WORKING FLUID

[75] Inventor: Jeffrey M. Hammer, St. Louis Park, Minn.

[73] Assignee: Honeywell Inc., Minneapolis, Minn.

[21] Appl. No.: 329,147

[22] Filed: Dec. 10, 1981

[51] Int. Cl.[3] ..... F23N 1/00; G06F 15/20

[52] U.S. Cl. ..... 236/15 R; 122/448 R; 236/78 D; 364/505

[58] Field of Search ..... 236/15 BF, 15 BG, 15 BR, 236/78 D; 165/26; 364/153, 557, 505; 219/510

[56] References Cited

U.S. PATENT DOCUMENTS 3,221,257 11/1965 Ohlson ..... 236/78 D X 3,591,077 7/1969 Alton ..... 236/78 D X 3,955,359 5/1976 Yannone et al. ..... 364/557 X 4,210,823 7/1980 Kabat et al. ..... 236/78 D

*Primary Examiner*—William E. Wayner

*Attorney, Agent, or Firm*—Alfred N. Feldman

[57] ABSTRACT

A condition control system adapted to supply a working fluid that has been modified by transferring energy to or from the working fluid is disclosed wherein a minimum energy loss is accomplished in operating the control system. The control system adjusts the setpoint of the system in response to parameters measured around the system and further provides for a minimum on/off cycling of the system in the event that the system is applied to a device which alters the working fluid between a fixed lower rate and an upper rate as would be typical in a burner-boiler configuration.

20 Claims, 14 Drawing Figures

CONDITION CONTROL SYSTEM FOR EFFICIENT TRANSFER OF ENERGY TO AND FROM A WORKING FLUID

BACKGROUND OF THE INVENTION

The transfer of energy to and from a working fluid typically is accomplished under the control of a condition sensing device such as a temperature responsive unit or a pressure responsive unit. Ordinarily, the condition responsive means measures a single condition of the working fluid and in turn controls the rate of transfer of energy to or from the working fluid in proportion to the deviation from a set point. This type of control system typically has a proportional offset which is an offset from the desired setpoint or control point established for the operation of the system.

In many systems, there is a minimum or fixed lowest possible energy transfer rate for the system. Above that minimum rate, the system typically can modulate continuously to some fixed upper limit. There are often startup energy losses associated with the transition between a complete off state and the lowest operating rate, each time the system is caused to cycle there can be significant startup losses.

The startup losses, and the operation of the system with a proportional offset, typically leads to certain inefficiencies. A more efficient manner of operating such a system can be brought about by minimizing the number of startup times for the system, and by tailoring the operation of the control so that the working fluid is not over heated or cooled to supply just the minimum amount of energy required to satisfy a particular load.

While the present description deals generally with condition control systems, a detailed description of a prior art type of condition control system will be described in the section of the application entitled "Description of the Preferred Embodiment" with reference to certain of the Figures which will be identified as prior art. This description will establish clearly what the prior art is, and will show why that type of prior art control system is deficient as relates to an efficient manner of operating a condition control system. The system that will be described will specifically be a boiler supplying steam to a steam heated load in response to a fuel burner control system even though any system that controls the transfer of energy to and from a working fluid in a similar manner would benefit from the present invention.

SUMMARY OF THE INVENTION

The present invention is directed to an improved condition control system which provides a more economical and efficient manner of operating the system. As indicated above, the present concept can be applied to many types of condition control systems, but the present description will be directed primarily to boilers in which water is converted to steam and then applied as the working fluid to a load. Under these conditions, a pressure sensor determines the condition of the working fluid and typically this type of system operates with a fuel burner that is initially operated to a lower on or low fire rate, and then released to an upper or high fire rate. Typically this type of system operates in a modulating manner between the two fixed rates in order to satisfy the demand for steam from the boiler. The pressure sensor regulates the burner. This type of system is inefficient in that each time the burner starts, losses accompany the startup, and further the system is inefficient in that the pressure sensor normally provides a much higher pressure than is necessary to efficiently control the load.

In the present invention the on/off cycling of the burner is regulated to minimize the number of starts and thereby eliminate some of the losses that accompany the startup of the burner. The present invention further senses the actual load on the boiler, and readjusts the setpoint of the system to insure that the setpoint is maintained at the lowest possible setting to satisfy the load conditions. The setpoint of the system is further adjusted by a different value when the load can be satisfied solely by the on/off cycling of the boiler between the minimum or off position and the low fire rate of the burner.

The present invention can also improve the efficiency of the burner or condition control system by adjusting the make to break differential that controls the on and off commands to the burner.

With the minimizing of unnecessary starts of the burner control system, and the further adjustment of the setpoint in response to the level of load, the present system is more efficient than a conventional burner control system. The improved burner control system is used as a vehicle in explaining the present invention, but it must be understood that the present concept could be applied to any type of condition control system in which a working fluid transfers energy to and from a load at varying rates. This could include a boiler operated merely to heat water, as opposed to generating steam. It could be applied to air conditioning systems in which the working fluid is a heat transfer fluid other than water, or it could be a condition control system in which the working fluid is air which transfers heat or cold from a heat exchanger to a load to which the working fluid is applied.

DESCRIPTION OF THE PREFERRED EMBODIMENT

Figure 1:
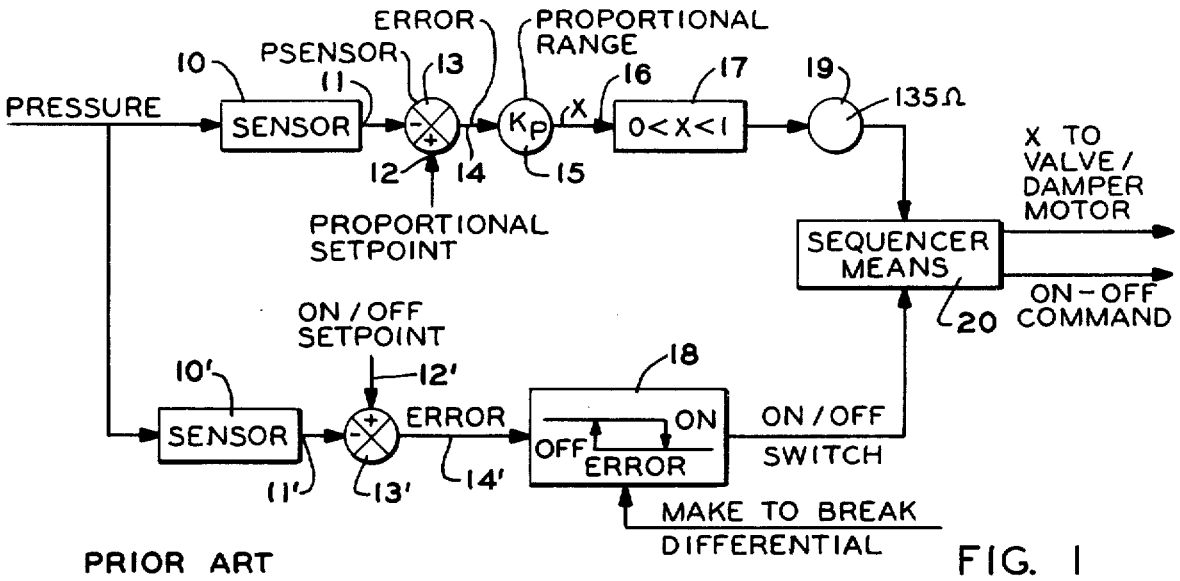
PRIOR ART FIG. 1
FIG. 1 is a prior art conventional proportional control system that includes an on/off control.

FIG. 1 is a schematic representation of a conventional steam pressure control which would be used to control the firing rate of a boiler. Steam pressure is the sensed parameter in this example, but the system can also be used as a temperature controller with replacement by the appropriate sensor. All of the discussion that follows applies equally for pressure or temperature controls.

The control schematic of FIG. 1 shows a prior art proportional pressure control with an on/off control combined. An upper signal path from a sensor means 10 to a condition control sequencer means 20 is a proportional path. A lower path from a condition sensor means 10' to the sequencer means 20 is an on/off control path.

There are typically two sensors in each application. The upper sensor means 10 is a proportional sensor which produces an output signal at output means 11 in proportion to the sensed pressure. The other sensor means 10' associated with the on/off control path produces at an output means 11' a discrete output indicating that the pressure level has risen above or fallen below a preset level. The sequencer means 20 coordinates the operation of the proportional and the on/off control circuits. When the sequencer means 20 receives the signal to turn on an associated burner, it initiates a sequence of safety related actions intended to safely light a burner flame. This sequence includes purging of the combustion chamber of accumulated unburnt fuels, lighting a pilot flame, checking the pilot flame to make sure it is actually lighted, and lighting off the main flame or burner. After the main flame is successfully ignited, the signal from the proportional control loop (which is fed from the sensor means 10 at the output 11), is used to control the flow of fuel through a valve directly in proportion to a pressure error signal. The output means 11 and a proportional setpoint 12 are differenced at 13 and provide a proportional error signal 14 through a conventional proportional range control and gain means 15 as a signal at 16. The signal at 16 is limited at 17 to control the sequencer means 20 via a variable resistance 19.

The functional elements shown in the proportional path originating with the sensor means 10 are typically all integrated into an electromechanical sensor. The sensed pressure is differenced at 13 with the setpoint 12 yielding at the error signal 14 from the setpoint signal. The error passes through an adjustable electronic gain means 15 yielding an error signal indicated at 16. The mechanical limitations of the sensing element (typically a potentiometer) impose limits on the error signal as indicated at 17. Typically the error signal would be considered as one ranging from 0 to 1. The 0 error signal is equivalent to the lowest firing rate that can be continuously sustained by a conventional burner. The error signal 1 is commensurate with the highest firing rate that the burner is capable of providing. The proportional signal resulting from the condition sensor means 10 is in effect a servo command that drives a servo motor attached to the fuel valve. This will be disclosed and described in more detail in connection with FIG. 2. Commonly the pressure, through a mechanical linkage, drives a potentiometer wiper to produce a variable resistance within the sensor which is proportional to the pressure difference from the setpoint 12. This variable resistance is connected in a bridge circuit which controls the operation of the servo motor. The servo motor moves the fuel valve to position it between its highest and lowest flow positions in proportion to the pressure error from the setpoint 12.

An on/off control sensor is shown schematically at 10' having an output means 11' in the lower circuit path. As before, the sensed pressure is differenced at 13' with an on/off setpoint of the on/off control circuit to produce an error signal at an output means 14'. The proportional error signal at 14' is converted to an on/off switched state by a hysteresis block shown at 18. When the error falls below a predetermined level at output 14', (the make level), the system switches from the off state to the on state. When the pressure rises to a higher predetermined level at 14', (the break level), the hysteresis block 18 switches back from on to off. The differential between the make level and the break level of the hysteresis block 18 is analagous to the proportional gain in the proportional control loop.

The proportional control plus the on/off control function disclosed in FIG. 1 is a conventional system to drive the sequencer means 20 to in turn control a burner in an on/off command mode, and then allowing the system to modulate from the low fire position of the burner to the high fire position of the burner. This conventional or prior art system has been disclosed to establish the environment of the present invention, and to allow a discussion of its deficiencies in order better lay the foundation for an understanding of the present invention.

Figure 2:
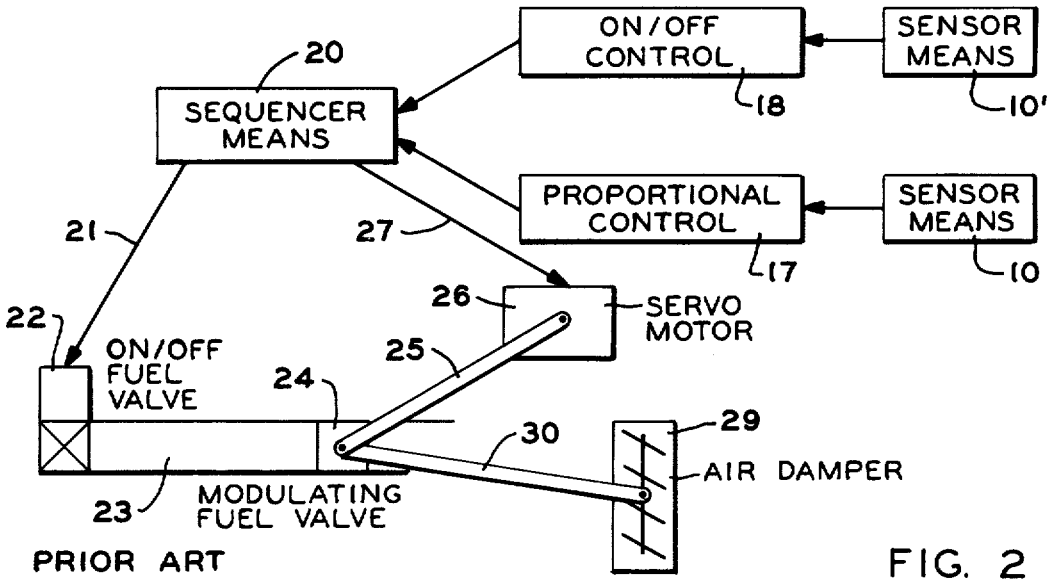
PRIOR ART FIG. 2
FIG. 2 is a representation of a modulating burner control system.

In FIG. 2 a block diagram of a conventional modulating control system is disclosed. The sensor means 10' is shown driving an on/off control 18 which is the on/off output error. The sensor means 10 is shown controlling the proportional control portion of the loop having the limited output means 17 (of FIG. 1) and these two controls in turn drive the sequencer means 20. The sequencer means 20 drives through means 21 an on/off fuel valve 22 in a fuel passage 23 that supplies fuel to a modulating fuel valve 24 that is controlled by a linkage 25 that in turn is driven by a servo motor 26. The servo motor 26 is controlled by means 27. The system is completed by a further linkage 30 that drives an air damper 29 that supplies the burner air for the fuel burner to which the modulating control system of FIG. 2 is adapted to be connected. The on/off control circuit operates the sequencer means 20 to light a flame or to extinguish it. The sequencer means 20 in turn coordinates the purge, light off, and fire sequencing of the burner to which the system is connected. This burner (and its associated boiler) has not been specifically shown, but its structure and operation are well known in the art. When the pilot light of the burner for the boiler is proved, the sequencer means 20 provides a signal through means 21 to open the on/off fuel valve 22. Once the main flame is safely established, the sequencer means 20 provides a proportional control signal through means 27 from the proportional control circuit 17 to the servo motor 26 which in turn controls the modulating fuel valve 24 by linkage 25. The servo motor 26 controls both the modulating fuel valve 24, and the damper 29 through the fixed mechanical linkages 25 and 30 to properly supply air at the rate controlled by the modulating fuel valve 24.

Figure 3:
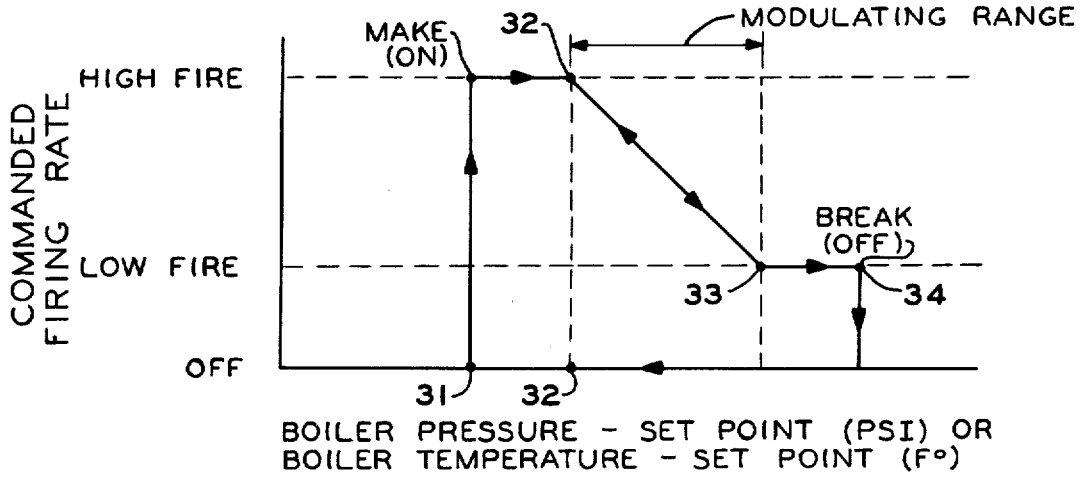
PRIOR ART FIG. 3
FIG. 3 is a boiler system controller graph of the sensed pressure versus the status of operation of the device.

In FIG. 3 there is disclosed a hysteresis diagram for the control system disclosed in FIGS. 1 and 2. The vertical axis of the diagram is the commanded firing rate of a burner with the high fire or maximum rate, the low fire or lowest sustainable rate, and the off or standby rate positions noted. The horizontal axis is the error from the setpoint in pressure or temperature, depending on the type of application of the system. A point 31 on the error axis is called the make point. The pressure must fall to the make point 31 in order to begin a firing cycle. When this happens, the sequencer means 20 (of FIGS. 1 and 2) initiates the purge and safe light off procedure for the associated burner. This procedure then commands the high fire fuel and combustion airflow to the burner. As pressure rises in the associated boiler, the highest firing rate is reached and maintained until a pressure point 32 is reached. As the pressure rises above the point 32, to a further point 33, the modulating or servo motor 26 of FIG. 2 closes the modulating valve 24 and operates the linkage 30 to reduce the airflow at damper 29. This operation drives the firing rate from a high firing rate down to a low firing rate at point 33. If the pressure within the boiler continues to rise beyond the point 33, a point 34 on the error axis at the low fire level is reached. The point 34 represents the break point or the off point for the burner. If the pressure rises above the point 34, the fire is shut off and the pressure begins dropping towards the make point 31. If the heat load imposed on the boiler requires a higher firing rate than the low fire position, the system will remain in the modulating range between the points 32 and 33 and will not cycle in an on and off fashion. If the heat load imposed on the boiler is less than the low firing rate commanded for the system, the boiler must cycle in an on and off fashion since the fuel valve 24 cannot be closed to a firing rate lower than the low fire position.

With the control configuration for a boiler as disclosed in FIGS. 1 through 3, the boiler will always light off and commence firing at the highest firing rate possible even under light load conditions. If it were possible to prevent the high firing rate under light load conditions, each on/off cycle will be longer causing the boiler operation to be more efficient. This efficiency improvement comes about because the on/off cycling looses energy due to the prepurge and postpurge operation of the sequencer means 20 and its associated burner. If the high fire were prevented, the boiler would stay on for a longer period of time servicing a greater load between each purge cycle. In this way more energy would be delivered per unit of energy lost to the purge process. The subject invention prevents a high fire operation by locking the boiler in the low fire mode after light off. The burner must remain in low fire for a predetermined interval, and the direction of change of pressure with respect to time is measured. If the pressure is rising while the burner is locked in low fire it is safe to conclude that the load imposed on the boiler is less than the low firing rate. Under these conditions the pressure will eventually rise to a break point and force the boiler off. Thus, it is not necessary to release the burner from the low firing rate during the cycle. If however, the pressure is falling after light off with the burner locked in the low firing rate, then the load on the boiler must be higher than the low firing rate. Under these conditions it will be necessary to release the control of the burner to the proportional path between points 32 and 33 of FIG. 3, which can then raise the firing rate as needed to match the load.

Attempts have been made in the past to prevent unnecessary high firing rates during cycling operation through the use of a lockout timer. The timer prevents higher than low fire firing rates for a fixed time interval after light off of the burner. The difficulty with this concept is, if the load is close to the low fire firing rate, a relatively short lockout time is insufficient to prevent the control system from commanding higher firing rates after the timer times out. If the lockout interval is made long enough to accommodate even very long on periods, the responsiveness of the control system to rapidly changing loads is compromised. That is, if the boiler is forced to remain in low fire for a long period of time and the load rises abruptly during that interval, the system will be unable to respond to the load increase causing a significant drop in the pressure from the control point. The present invention overcomes this problem since the rate of change of pressure is measured essentially continuously and the boiler will be released to the high firing rate whenever the pressure begins to fall. In this way, a rapid increase in load is detected essentially instantaneously and a higher firing rate is commanded before a significant pressure drop occurs. This same concept can be applied in boilers which are operating in the hot water mode, as well in the steam generating mode. In this situation the rate of change of temperature is measured and the firing rate is controlled in the same manner as explained above.

Conventional burner and boiler controls operate in an on/off cycling mode under light loads and in a proportional mode at higher loads. When the boiler is modulating in the proportional control mode, the boiler pressure remains somewhat offset from the setpoint due to the phenomenon known as proportional offset. The mechanism which causes this problem can be seen in FIG. 3. When the load is high, the pressure must fall toward the beginning of the modulating range (point 32) to cause the firing rate to be increased. When the load is low, the pressure rises towards the point 33 which reduces the firing rate causing the load and the firing rate to come in balance with each other. This migration of pressure with load is called the proportional offset. The gain of the system determines the magnitude of the offset. The gain of the system is the slope of the firing rate versus the error plot on FIG. 3. This is the slope between the points 32 and 33. With a very high gain (a steep slope) the variation in pressure required to cause a large change in firing rate is small. Hence, the offset in the pressure is small. This higher gain also leads to instability. Thus, with practical gain settings the pressure or temperature in the boiler is highest under light loads and lowest under high loads. This is just opposite the desired condition for maximum efficiency in the boiler operation.

A more efficient operating mode would be to have higher steam pressure or higher temperature when the loads are highest, and a lower steam pressure or temperature when the loads are low. In this way the boiler internal temperature will be as low as possible under each loading condition. To determine how maintaining the lowest possible temperature yields the highest operating efficiency, a typical boiler construction should be considered. Fuel is burned in a chamber called a fire box giving up some of its heat to the surrounding water. The combustion products pass through the boiler's heat exchanger which is made up of a number of small tubes and heat is removed bringing the combustion products downward in temperature until they leave the boiler and any remaining heat is lost up the flue. The cooler the boiler water temperature, the lower will be the temperature of the exiting combustion products. In this way the lower operating temperature yields higher efficiency.

In most applications, the boiler setpoint is higher than necessary to service the loads. The heat from the condensing steam is transferred to the end use via a heat exchanger. The heat exchangers are typically sized to handle the load on the system with a reasonable temperature drop from the steam temperature to the end use load temperature. To control the rate at which heat is delivered to the load a local loop control is often employed. This control senses the temperature at the load to be controlled, and adjusts the steam flow rate to the heat exchanger to maintain the desired condition. A control valve causes the steam at the load to be at a lower pressure, and hence, a lower temperature than it was generated at in the boiler. Thus at light loads, the boiler temperature is often higher than the actual temperature at which heat is being delivered from the steam at the load. Under these light load conditions, it would be desired to reduce the boiler setpoint making the boiler operate more efficiently because the loads can be satisfied with lower temperature steam. Under high load conditions, it would be necessary to raise the boiler setpoint so that the required temperature drop from the steam to the end load is available at the heat exchanger to guarantee the higher heat flow rates required. The subject invention adjusts the boiler setpoint automatically with boiler load. The key to this process is the ability of the controller to sense the total load on the boiler.

Before describing the block diagram of the system incorporating the invention as disclosed in FIG. 4, two concepts that are utilized in the invention will be discussed and their operation described.

Burners for boilers operate in two modes. There is an on/off cycling mode and a modulating mode. In each mode of operation the present invention is able to sense the net imposed heat load on the boiler, and reset the setpoint of the system according to the load. Under light load conditions when the boiler must cycle on and off, the present invention locks the firing rate at its lowest level. Under these conditions, the imposed load on the boiler can be determined by timing the duration of the on and off cycles. The ratio of the on time divided by the sum of the on and off times is equal to the ratio of the load on the boiler divided by the boiler's capacity with the burner at low fire. The present invention (in cycling operation) measures the half cycle times and computes the load using the above relationship. The load is in turn used to reset the setpoint of the system. Manual adjustment is possible. The operator can prescribe a setpoint to be associated with loads at the lowest firing rate. The operator also can adjust a setpoint associated with the standby or zero load condition. The device automatically senses the magnitude of the load between the zero and the low fire sensing rate, and adjusts the setpoint between the two manual inputs setpoints.

When the load on the boiler is greater than the low firing rate, on/off cycling should not occur. Under these conditions, the present invention adjusts the firing rate via the conventional proportional control path to match the firing rate with the imposed load. Under steady state conditions, the proportional control path leaves a proportional offset in pressure between the sensed pressure and the desired setpoint. When the loads are low, the offset is also low. When the loads are highest, the proportional offset is equal to the modulating range of the control system. That modulating range is the distance on the pressure axis of the graph of FIG. 3 between the points 32 and 33. It is well understood that a simple proportional control device can be improved with the application of a technique commonly known as integral action. With this technique the steady state proportional offset can be eliminated. The technique is to pass the error signal in the proportional control path through an integrator. The integrated pressure error signal is added to the proportional control signal. This technique drives the sensed error signal to zero as the integral of the error signal rises to a level such that the integral output alone commands the required firing rate to maintain the setpoint without offset. In equilibrium, the proportional control has zero output and the integral control determines the firing rate. The integrator output in steady state is equal to the proportional offset that would have occurred had integral action not been employed. In this way the integral output just cancels the proportional offset. The integral output is also a measure of the load on the system. This is critical to the present invention, as the integral output is used in the novel system disclosed in FIG. 4 for a specific control purpose. The ratio of integral output divided by the magnitude of the modulating range is equal to the load imposed on the boiler divided by the difference between the high firing rate and the low firing rate. Thus, the integral output is a direct measure of where the load level is relative to the highest and lowest firing rates. Thus, the integral output can be used to reset the setpoint of the control system when it is operating in the modulating mode.

The block diagram of FIG. 4 will now be described and the application of the principles enumerated above will be applied to develop the invention contained in the system of FIG. 4. The diagram of FIG. 4 will be explained with the components identified prior to an explanation of how the system works. The condition control system disclosed in FIG. 4 will be specifically described as a fuel burner control system adapted to heat water in a boiler for generation of steam with the steam used as the working fluid for the system.

Steam pressure 40 is applied to a condition sensor means 41 that typically would be a pressure sensing device. The sensor means 41 would have output means 42 connected to a differencing means 43 that differences a signal PSET from a setpoint means disclosed at 44. The details of the setpoint means 44 will be explained subsequently, but it should be understood that the setpoint means 44 has the output PSET which represents a modified setpoint for the condition control system.

The output of the differencing means 43 is provided at output means 45 which in turn provides a signal EP which is the preliminary error signal for the system. The preliminary error signal EP is provided at an input means 46 to an error signal processing means generally disclosed at 50, and is further provided by a conductor 47 as a preliminary error signal EP to an on/off error detection means generally disclosed at 51. The error signal processing means 50 processes a continuous signal used in the system, while the on/off error detection means 51 provides an on/off switching action within the device. Their detailed functions will be described after the balance of the system has been enumerated.

The input means 46 to the error signal processing means 50 provides the preliminary error signal EP to a gain element 52. The gain element 52 can be of any type, and typically would be adjustable to make the system applicable to different types of condition control systems. The gain element 52 has output means 53 that is connected to an error signal limiting means 54 that limits the preliminary error signal EP to a range of between $-1$ and $+1$, and provides it to an output conductor 55 as an error signal output means for the error signal processing means 50.

The error signal output means 55 is connected to a further gain element 56 that in turn is connected to an integrator means 57. The integrator means 57 has an integrator output signal I that in turn is supplied to a limiting device 60 that limits the integrated signal I to a range of 0 to $+1$. The limiting device 60 has an output means 61 that supplies the integrated signal to a summing means 62 where the error signal output means 55 is summed, and where a sequencer command output signal X is provided to a conductor to a limiting device 63 that limits the sequencer command output signal X to a range of 0 to +1. The output of the limiter means 63 is to a conductor 64 to a gate means 65. The gate means 65 has an output 66 and provides a sequencer command output signal that varies in a modulating fashion. The output 66 is connected to a converter 67 that converts the signal X to a varying resistance value at the conductor 70 which is in turn used to drive a condition control sequencer means 71. The condition control sequencer means 71 is a conventional burner sequencing type control and could be of the type known as the R4140L sequencer as manufactured and sold by Honeywell Inc. The sequencer means 71 has an output signal at conductor 72 that in turn controls the servo motor 26 of FIG. 2. A typical burner control system would have a flame detector to supply information back to the condition control sequencer means 71 and is disclosed at conductor 73 as a flame detector input to the sequencer means 71. The sequencer means 71 has a further input 74 that is an on/off type of command and would be similar to the on/off type control 18 of FIG. 2. The conductor 74 is connected to the on/off error detector means 51 which is a hysteresis type of on/off control device similar to the device 18 of FIGS. 1 and 2. The condition control sequencer means 71 has one further output at 75 that is used for control purposes within the system. That control purpose will be described subsequently.

The setpoint means 44 has been previously mentioned and it will now be described in some detail. The setpoint means 44 has at least two different operating modes and includes adjustable input means 80, 81, and 82. The adjustable or manual input means 80 is used to set the operating pressure for the device at its highest fire rate. The manual input adjusting means 81 is used to establish the pressure at the low fire rate. A third manual setpoint input 82 is provided to set the off position or quiescent normal state for the boiler when it is not supplying a load, but when it is ready to be activated. All of the setpoint means 80, 81, and 82 could be combined at 83 into a single setpoint member that is controlled by knob 84 that would set all three elements into the setpoint means 44 at the same time. It should be understood that the three setpoint values 80 (PH), 81 (PL), and 82 (POFF), are all definite pressure levels that must be set into a system for its proper operation. The use of this information will be explained after the other inputs to the setpoint means 44 have been established.

The sensor means 41 is shown as having an output means 42 that feeds the differencing device 43 directly. The output means 42 also supplies a signal by a conductor 85 to a load responsive means generally disclosed at 86. The load responsive means 86 has at least two distinct functions. The first function is to sense the pressure from the sensor means 41 and determine whether the pressure is rising or falling. This pressure direction portion can be accomplished by a differentiation of the signal or by a simple comparison of short time intervals to determine whether the pressure is rising or falling. This signal is indicated by the portion of the load responsive means 86 as a portion 87. The load responsive means 86 has a further portion 88 that is a time delay. This time delay is necessary in a practical embodiment to prevent the system from improperly responding during transient conditions, such as the startup, of the burner when the pressure in the boiler might not be responding directly to the action of the burner applied to the boiler. The load responsive means 86 has an output means 90 that acts as a limit switch and will be designated as LS for the device. This limit switch action LS is supplied by a conductor 91 as a switched output signal to three elements. The first element that is applied to is the gate means 65 thereby determining whether or not the sequencer command signal X is to be passed from conductor 64 to 66. The signal LS on conductor 91 is further supplied by conductor 92 as an input to the setpoint means 44. The limit switch action LS is further supplied on a conductor 93 to a make to break differential device generally disclosed at 94. Since the limit switch signal LS is a switch signal, it can be considered as either a logic 0 or a 1. In the present system the signal LS is considered as a 1 when the system is locked or operating in the low fire condition, and is considered a 0 when the system is operating in a modulating manner. The reason for this will be explained later in connection with the operation of the overall system. The main thing is that it should be understood that the limit switch LS provides two separate signals that allow for two modes of operation of the setpoint means 44, and for two different modes of operation of the make to break differential means 94. The make to break differential means has a manual input 95 that establishes a manual make to break differential. This make to break differential is then provided as a signal at output conductor 96. A first output signal is provided equal to the manual input if the signal LS is equal to the logic 1 and is only 40 percent of the make to break differential in the event that the limit switch LS is providing a logic 0 to the system. This allows for operating the system in two different modes for more stable operation, as will be explained later. The make to break differential means 94 provides an input to the on/off error detection means 51 and establishes the magnitude of the signal EP that is an input that will cause the on/off error detection means 51 to switch its output at conductor 74.

The output at conductor 74 is coupled directly at 97 to the load responsive means 86 as an input, or can be coupled by a conductor 98 from the output 75 of the condition control sequencer means 71. In either case, the input to the load responsive means 86 is a on/off command to the load responsive means 86, the purpose of which will be explained in connection with the operation of the overall system.

The system is completed by the addition of a cycle timer means 100 that has an input 101 connected directly to the sequencer means 71 by the conductor 75. The cycle timer means 100 has an output PON at conductor 102 which is connected at 103 as an input to the setpoint means 44. The cycle timer means determines the output signal PON which is equal to the time on divided by the time on plus the time off. This, in effect, provides a signal that tells the setpoint means 44 the percentage of on time in the previous complete on/off cycle.

Before a complete description of operation is provided it will be noted that the setpoint means 44 has two different operating modes that are established by the limit switch action LS provided as an input at the conductor 92 from the load responsive means 86. If the limit switch LS is equal to a logic 0, then the output of setpoint means PSET is a function of the manual setpoints 80 and 81 along with the integrated signal I. If the limit switch signal LS is a logic 1, then the setpoint output PSET is a function of the manual setpoints 81 and 82, along with the half cycle timer input 103 as PON. These two modes of operation are critical to the proper operation of the present system and provide a setpoint shifting signal PSET that is differenced with the output means 42 of the pressure sensor means 41.

OPERATION OF FIG. 4

Figure 4:
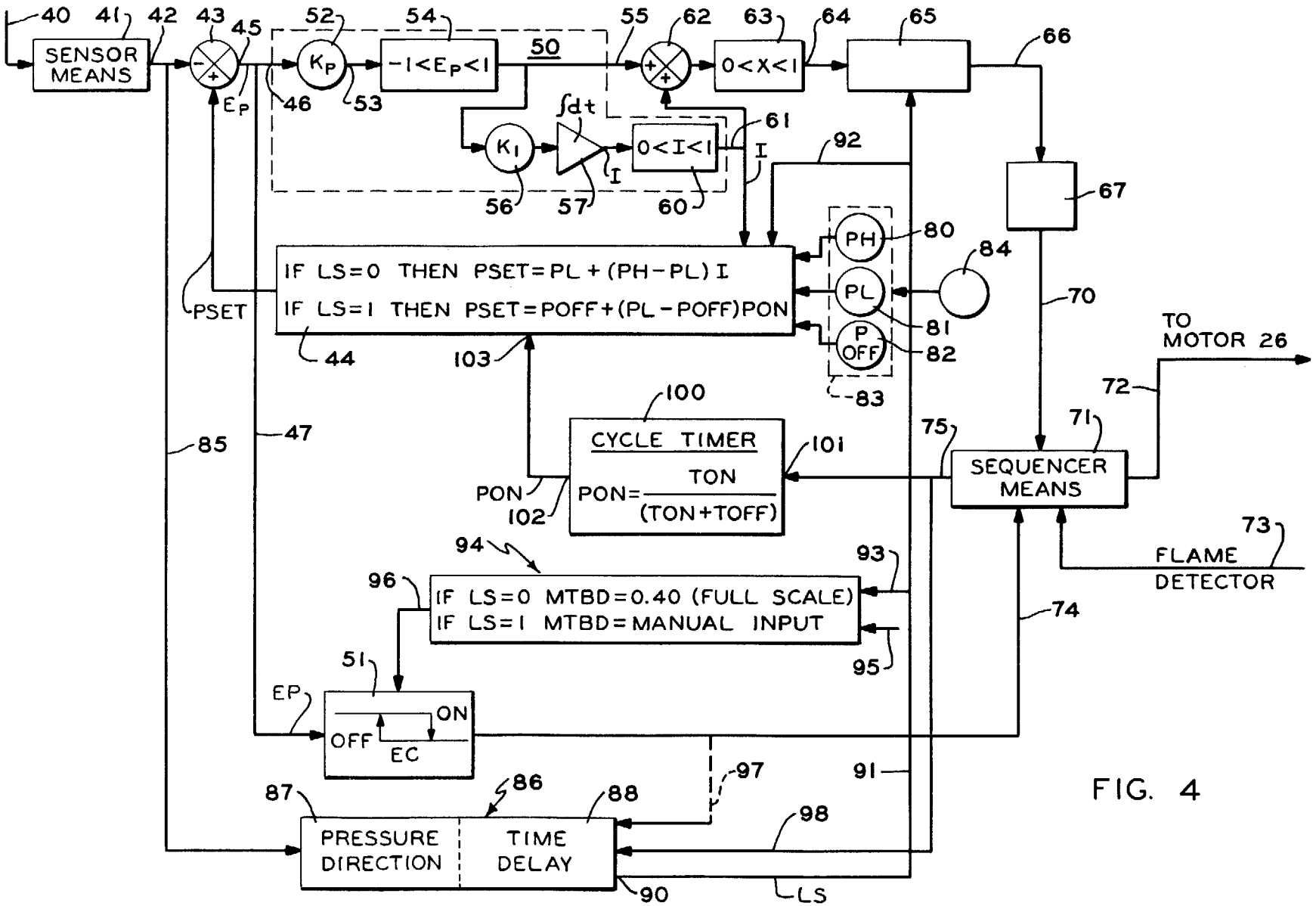
FIG. 4 is a block diagram of the improved condition control system.

The system disclosed in FIG. 4 replaces a conventional control system of the type disclosed in FIG. 1. Beginning with the pressure sensor means 41 a signal can be described as flowing through the subject system. The sensor output means 42 is differenced at 43 with the setpoint PSET and passes through the gain element 52, as was the case with a conventional control. The preliminary error signal EP is limited to a range of −1 and +1. In this description a signal of 0 is equivalent to a low fire firing rate for a burner, while a signal level of 1 is the highest fire firing rate. Thus, the proportional error at the error signal output means 55 can command the highest firing rate even with the output of the integral action providing an integral signal I of 0 at 61. Similarly, a sufficiently large negative proportional error could completely cancel the integrator output. The preliminary error signal EP splits and proceeds to a summing means 62 and also enters the integrator 57 to provide an integral action. The output of the integrator 57 at I is limited to a range of 0 to 1. The integral output at 61 is added to the proportional error from the error signal output means 50 at the summing means 62 to provide or yield a net condition control or actuator command X. The actuator signal X is limited at 63 to a range of 0 to 1. The actuator command X passes through a gate means 65. The input to the gate means 65 is the limit switch signal LS. If the limit switch LS is high, that is a logic 1, the output signal of the gate means 65 is 0, locking the burner for the boiler in the low fire condition during on/off cycling. This function is a derivative action as the limit switch LS is controlled by the rate of change of pressure as described earlier. When the limit switch LS is off or at a logic 0, the actuator or condition control sequencer means command signal X passes unchanged through the gate means 65. The signal X is converted into an output signal by 67 that is capable of driving the servo motor 26. The final condition signal from the element 67 at conductor 70 connects to the condition control sequencer means 71. The sequencer means 71 passes this signal unchanged to motor 26 after it has safely ignited the main burner flame.

It should be noted that the output of the integrator 57 at the conductor 61, as an integrator signal I, passes in two different paths. In a first path it is added to the proportional error signal output means at the summing means 62, and it also passes into the setpoint means 44. If the limit switch LS is in the logic 0 state indicating proportional operation, the setpoint means 44 functions according to the upper formula shown in the block labeled setpoint means 44. The output of the setpoint means 44 is then used as the signal PSET to the differencing element 43 to reset the effective setpoint for the control system.

The output of the setpoint means 44 PSET is equal to the desired low fire setpoint PL plus the difference between the high fire setpoint PH and the low fire setpoint PL times the output of the integrator I. The desired high fire and low fire setpoints are manually set inputs 80 and 81. With this relationship, the setpoint means 44 will adjust to the low fire value when the integrator output is zero indicating low loads. When the integrator output is 1, the setpoint means 44 is adjusted to provide a PSET output representing the need for a high fire setting. When the loads range between the high and the low fire operating points, the setpoint means 44 is linearly adjusted automatically between the manually inputted values 80 and 81 for the high fire and low fire settings. In this way the device can be adjusted to automatically raise and lower the setpoint with load. The high fire and low fire setpoints can be determined by trial and error at the actual installation of the burner and boiler. The highest efficiency is obtained when both values are adjusted as low as practical subject to the requirement of satisfying the end use for loads.

The sensed pressure signal at the output means 42 of the sensor means 41 provide a preliminary error signal EP that is also used for another function. The preliminary error signal EP is converted to an on/off digital command in the on/off error detection means 51. When the sensed pressure falls below the setpoint by a predetermined magnitude, the on/off error detector means 51 switches from an off state to an on state. When the sensed pressure rises above the setpoint by a different predetermined level, the on signal switches back to the off signal. This signal path replaces the on/off circuit 18 in the conventional control. The on/off command passes from the on/off error detection means 51 by the conductor 74 to the condition control sequencer means 71 to allow for normal startup of a burner as controlled by the sequencer means 71. At the same time the on/off command can either be directly used to operate the load responsive means 86 or it can be controlled by way of conductor 98 to supply the control of the load responsive means 86. This operation causes the load responsive means 86 to function in response to the on/off command and helps determine the limit switch LS output at conductor 91.

The pressure sensor means 41 also directly passes a signal via the conductor 85 to the load responsive means 86. The purpose of the load responsive means 86 is to determine the sign of the time rate of change of pressure (that is to determine whether the pressure is rising or falling). This can be accomplished either as a differentiation or by measuring fixed intervals of time and making a comparison of present with past signal levels from sensor means 41. Whenever the on/off command signal from the conductor, 98 or 97 (not both, either 98 or 97 can be used with 98 the preferred method) switches from an on to an off state, the limit switch LS is set to a logic 1. That is, whenever the burner is turned off, it is assumed to be in the cycling mode of operation and the firing rate is locked to the low fire position whenever the boiler and its associated burner restart. When the boiler is turned back on again and begins firing, the limit switch LS will be set back to a logic 0 if the pressure falls indicating the load has risen above the lowest firing rate. The fact that the pressure is falling is not meaningful until the fire has successfully ignited and combustion has been underway for an interval sufficiently long to yield a good measure of the rate of change of pressure in the boiler. Typically this takes one to two minutes after the firing is initiated. A timer or time delay 88 within the load responsive means 86 maintains the limit switch LS in the high fire state independent of the rate of change of pressure until the necessary time delay interval has passed. This assures that the startup transients will be excluded from controlling the sytem. From then on, the limit switch LS remains high as long as the pressure is rising. Whenever the pressure falls, the limit switch LS is set to 0 and the modulating operation of the system is allowed. The limit switch action LS can only be reset back to a logic 1 if the boiler is turned off again.

In considering further the setpoint means 44, it is noted that a different setpoint relationship is utilized when the limit switch LS is in its high state. Under these conditions, the burner is cycling on and off with the firing rate locked in its lowest position. In this case, the formula is driven by the percent on time signal PON at the input 103 to the setpoint means 44. The percent on time signal comes from a cycle timer means 100. The cycle timer means measures the time that the fire is on and the interval the fire is off during each cycle. The fire control sequencer 71 feeds back a digital signal indicating that the fire has successfully lit off to control the cycle timer 100. The percent on signal is equal to the on time divided by the sum of the on and off times of the previous half cycle. During cycling operation, the on and off time intervals utilized in the noted cycle timer means 100 utilize information stored from the most recent cycle. As a switching event from on to off, or from off to on occurs, the appropriate time value is updated to its most current recorded level. If the current on or off time intervals become longer than the previous recorded value, then the previous recorded value is updated to the current notation of the present half cycle. In this way the percent on signal is maintained at the most current indication of load. When the limit switch LS is high, the pressure setpoint PSET is equal to the desired standby pressure POFF plus the difference between the desired low fire setpoint PL minus the desired standby setpoint POFF multiplied by the percent on PON signal. The standby pressure is the desired condition when the load has fallen to zero. This would be the hot standby condition of the boiler. When the percent on signal is 0, the setpoint is the standby setpoint. When the percent on signal rises to 1, the low fire setpoint is utilized. The setpoint means 44 automatically adjusts the setpoint between these manually inputted levels with load variation. In this way the setpoint of the system is automatically adjusted with load to its minimum allowable value during the modulating operation (with the limit switch LS at 0) and the cycling operation (with the limit switch LS at 1).

The limit switch LS output is also used to control one other feature of the referenced invention. The limit switch LS signal passes through the make to break differential means 94. The make to break differential means determines the pressure level at which the on/off command signal is switched. When the burner is in the cycling operation mode the make to break differential MTBD is left at the level of the manual input to the system. The operator can adjust the make to break differential to constrain the amplitude of pressure variations during the on/off cycling. When the make to break differential is small, the boiler cycles rapidly between the highest and lowest pressure levels. When the make to break differential is larger the boiler cycles more slowly with a large pressure amplitude. When faster cycling occurs, greater cycling losses and less efficiency occur. Slower cycling is more efficient but the pressure amplitude is greater. The operator can determine the acceptable level of cycling. It was determined through stability analysis that it is desirable to use a larger make to break differential when the boiler is operating in a modulating mode (that is with the limit switch LS at 0). During modulating operation the sensed pressure will remain near the setpoint value as long as the loads remain relatively steady. As the load changes abruptly, the pressure will drift off of the setpoint until the control system can adjust the firing rate and reestablish equilibrium conditions. If the break level is too close to the setpoint during modulating operations, an abrupt load drop of a few percent can cause pressure to rise to the break level before the proportional control loop can readjust the firing rate. Under these conditions unnecessary on/off cycling can occur. To prevent this, the make to break means 94 is provided with two levels and is allowed to expand during the modulating operation so that the pressure must rise significantly above the setpoint to switch off the burner. This eliminates unnecessary cycling, and improves stability and thereby saves energy.

The present invention utilizes two interrelated concepts. The first is the derivative action technique which limits the firing rate to its lowest level during on/off cycling. The limit switch output also indicates whether the boiler is in the cycling mode or the modulating mode of operation. This information is necesary to utilize the percent on or the integrator output as a measure of load on the system. With this measurement of load, it is possible to reset the setpoint means 44 thereby maintaining the lowest possible temperature and hence highest efficiency operation possible under varying load conditions. The reset concept must include some type of load responsive means to determine the direction that the temperature or pressure is varying.

The implementation disclosed in FIG. 4 can readily be provided by the use of microprocessor or microcomputer technology that is commonplace today. All of the functions can readily be entered in a program for a microcomputer so that the implementation of the concept is very economical. It should be noted that the present system could be readily built up of conventional relays, level detectors, and amplifiers. The particular mode of implementation is not material to the present invention and the fact that it could be implemented with a microprocessor makes all of the functions that have been described convenient and readily apparent to one skilled in this art.

Figure 5:
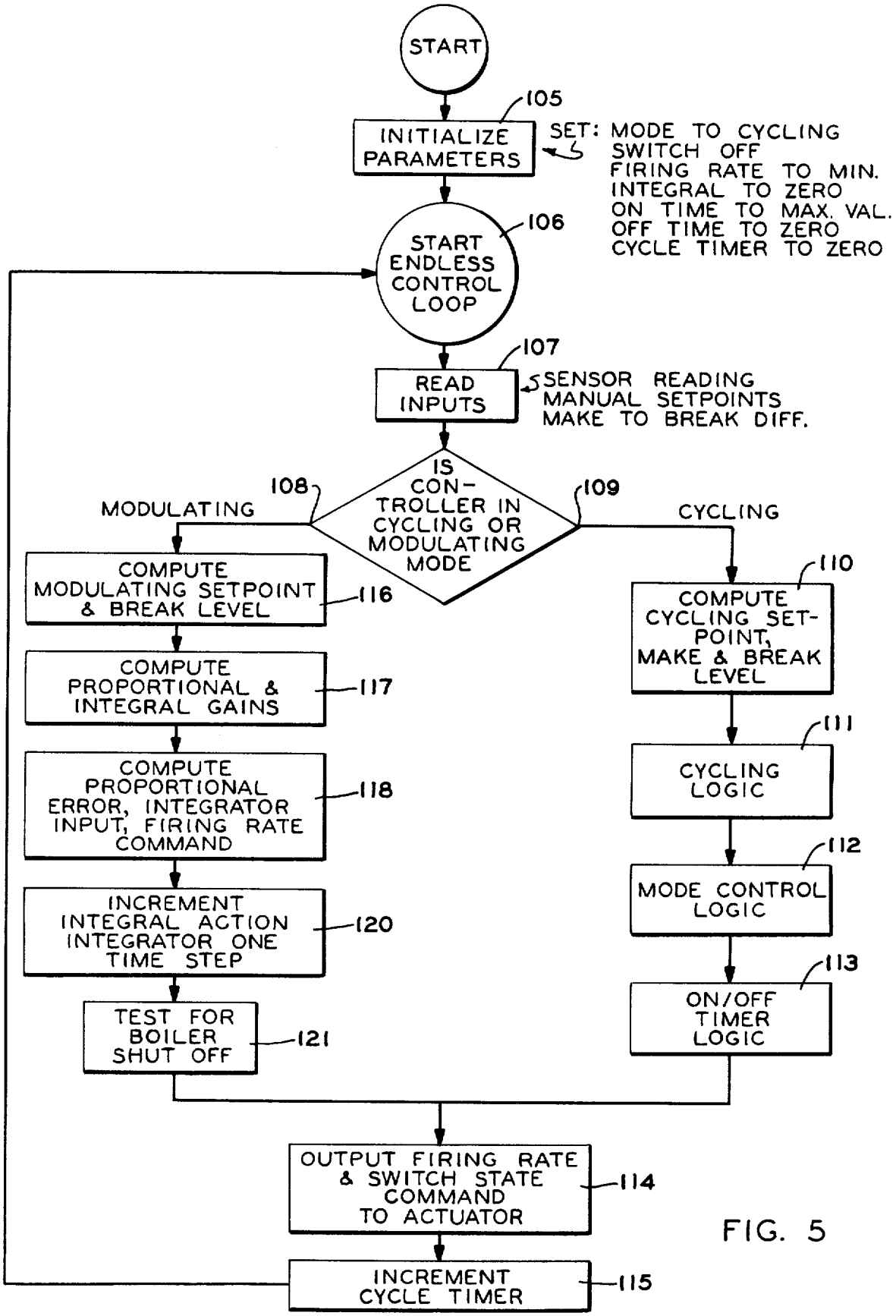
FIGS. 5 to 14 are flow charts showing the functions of the system of FIG. 4.

In FIG. 5 a flow chart is disclosed describing the basic function of the circuit disclosed in detail in FIG. 4. The condition control system is a single input, dual output control. The system senses boiler pressure or temperature and controls the on/off switch to the sequencer means 71 and the firing rate control signal. The system has two internal states, modulating and cycling. The cycling state consists of on/off cycling with the firing rate locked in the lowest firing rate position. The setpoint means 44 is adjusted with load by timing the on/off cycle durations and adjusting the setpoint means accordingly. The device is in the cycling mode whenever the load on the boiler is less than the lowest possible sustained firing rate. The system enters the modulating mode whenever the loads are higher than the lowest possible sustained firing rate. In modulation, the boiler is continuously on and the firing rate is varied between the lowest and highest firing rates possible. In modulation, the integral action of the error signal processing means 50 is utilized to eliminate the proportional offset between the pressure and the setpoint in steady state. The output of the integral action or error signal processing means 50 is also used to reset the setpoint means 44 with load variations. Internal to the system, seven control parameters must be retained in memory. These parameters are, the control mode LS (cycling or modulating), the output switch state, the firing rate command, the output of the integral action integrator I, the timed duration of the most recent complete firing cycle (on time), the most recent complete off cycle duration (off time), and the duration of the present half cycle.

FIG. 5 shows the overall flow chart for the control system. Most of the function blocks shown have detailed flow charts which follow FIG. 5 as FIGS. 6 to 14 as subfunctions. When the microprocessor-based control device is initially powered up, the seven internal memory states must be set to a reasonable predetermined value. The function block 105 sets the mode to the cycling condition with the output switch off. The firing rate command is set to the minimum value and the integral action output is set to zero. The stored on time is set to its maximum value and the stored off time is set to zero. The current cycle timer 100 is also set to zero. Thus, the control starts up with the boiler off and the cycling mode underway. The internal setpoint will be adjusted to the setpoint associated with low fire loads. After the initialization process is complete, the system enters its endless control loop 106. The control loop begins by reading the inputs 107 to the system. The inputs include the pressure or sensor means reading at 41, the manual setpoints 80, 81, and 82, and the make to break differential 94 associated with the cycling mode. The flow branches to the cycling mode 108 or modulating mode 109 depending on the state of the mode flag. If the system is in the cycling mode, the system computes at 110 the setpoint and make to break levels associated with cyclic operation for the setpoint means 44. The cycling logic block 111 compares the pressure reading with the make and break points to determine the proper output switch state. The mode control block 112 tests for the need to release the system to the modulating mode, i.e., if the burner is on and the pressure is falling, the system is released to modulation which allows higher firing rates. The on/off timer block 113 controls the timing of each cycle and the update of the stored values of the most current complete on and off cycles. Each of these four subfunction blocks have detailed flow charts which will be explained later. Upon completion of the cycling functions, the firing rate 114, which was set to its minimum value, is outputted to the actuator. The switch state output 115 is also updated and the cycle timer 100 is incremented by the amount of time required to complete one pass through the endless control loop. Then the endless loop is begun again.

If the system is in the modulating mode 108, the setpoint and break level associated with modulating operation is computed at 116. From the setpoint and pressure readings, the proportional and integral gain 117 appropriate to the application and pressure range is computed. The integral and proportional gains 117 must be adjusted for the amount of pressure reset commanded by the operator and the pressure range of operation. These automatic gain adjustments assure stable operation with consistent dynamic response under all operating conditions. With the appropriate gains, it is possible to compute the proportional and integral error 118 which in turn yields the firing rate command. The integral action integrator 120 must be numerically integrated one step each control cycle. Finally, the pressure reading is compared with the break level appropriate to the existing conditions 121. If the pressure exceeds the break level, the boiler is switched off and enters the cycling mode on the next pass through the control loop. The detailed logic associated with each of the modulating function blocks will be explained later. After the modulating function blocks have been executed, the device again outputs the firing rate and switch state command to the actuators 114. The cycle timer 115 is again incremented and the endless control loop beings again.

Figure 6:
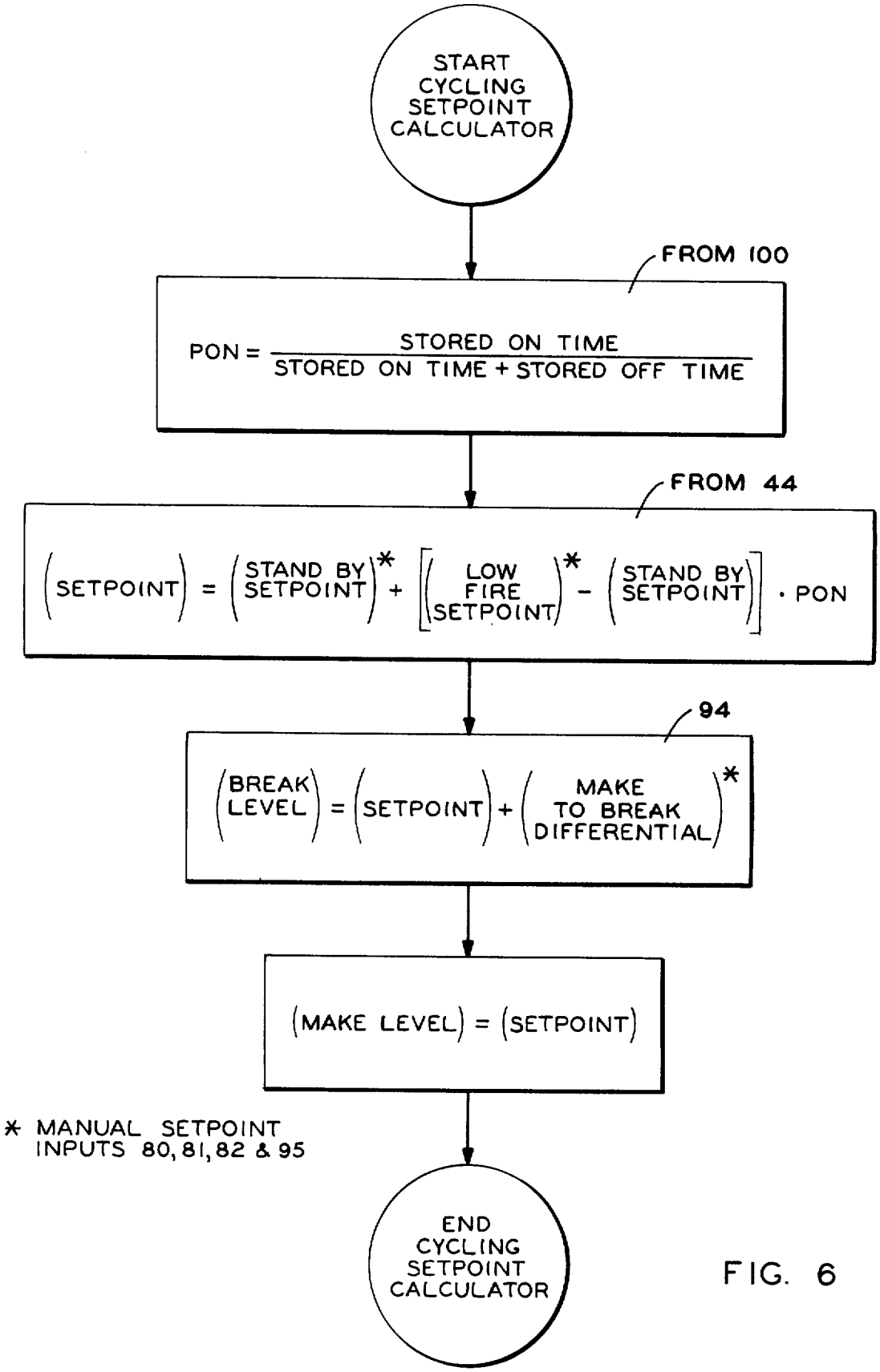

FIG. 6 shows the detailed flow of the cycling mode setpoint calculation. The first step is to compute the fraction of on time during the last complete on and off cycle. The on time fraction (PON) is equal to the stored on time divided by the sum of the stored on and off times. The on/off timer control logic flow chart will explain how these stored on and off times are updated through each firing cycle. The internal setpoint associated with cycling is equal to the standby or zero load setpoint POFF plus the on time fraction PON multiplied by the difference between the setpoint associated with the low fire load minus the standby setpoint value. Both the standby and low fire setpoints are direct manual inputs, or can be derived from the manual inputs. This function causes the internal setpoint to range from the lowest setpoint linearly up to the low fire setpoint as the fraction of on time goes from zero (no load) up to 1 (low fire load). The break level associated with cyclic operation is the internal setpoint plus the manually inputted make to break differential. The make level is simply equal to the internal setpoint. This completes the computation of setpoint make and break levels.

Figure 7:
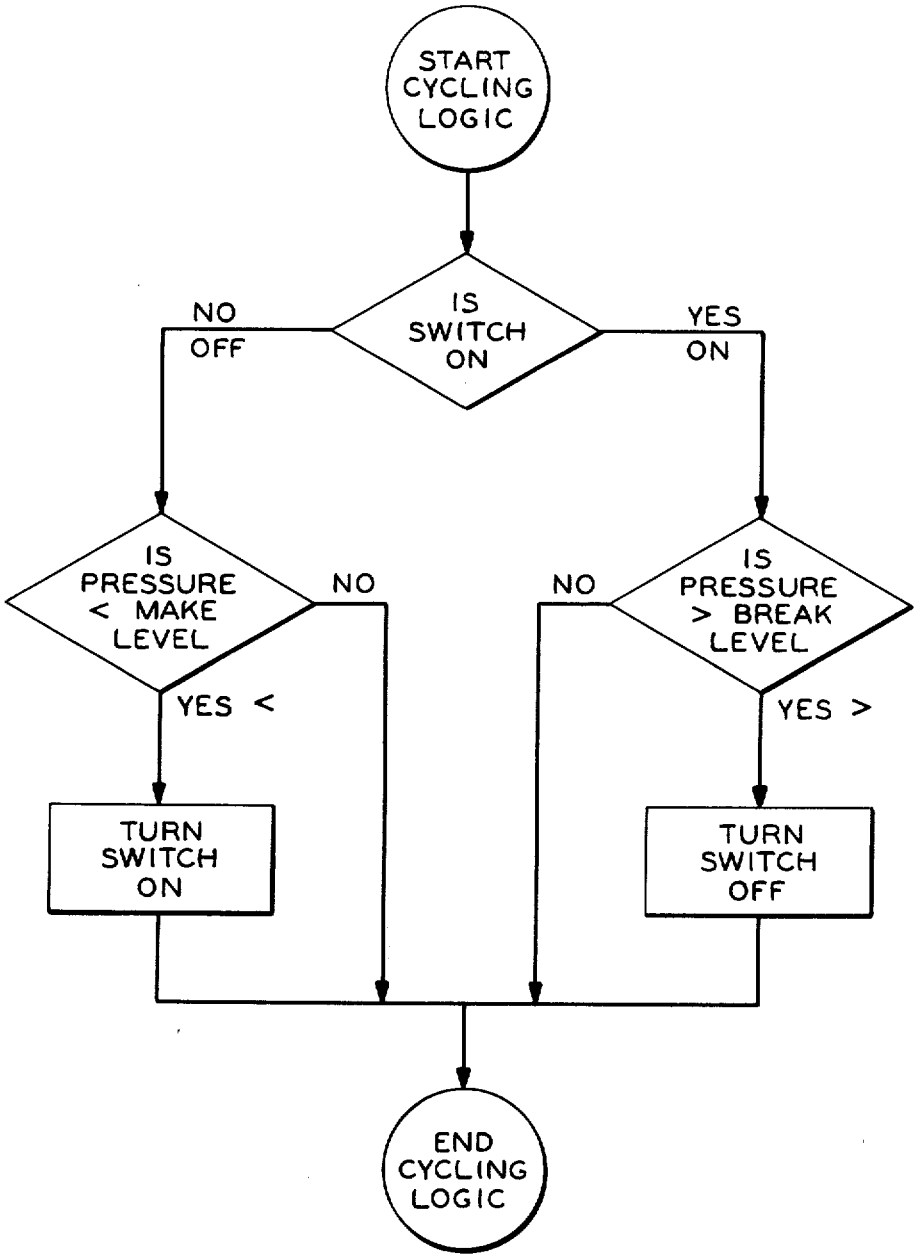

The flow chart in FIG. 7 shows the on/off cycling logic. If the switch is on, the sensed pressure is compared with the break level. If the pressure is above the break level, the switch is turned off. If the pressure is below the break level, the switch state remains unchanged. If the switch is off, the pressure is compared with the make level. If the pressure has fallen below the make level, the switch is turned on. If the pressure remains above the make level, the switch state remains unchanged (off).

Figure 8A:
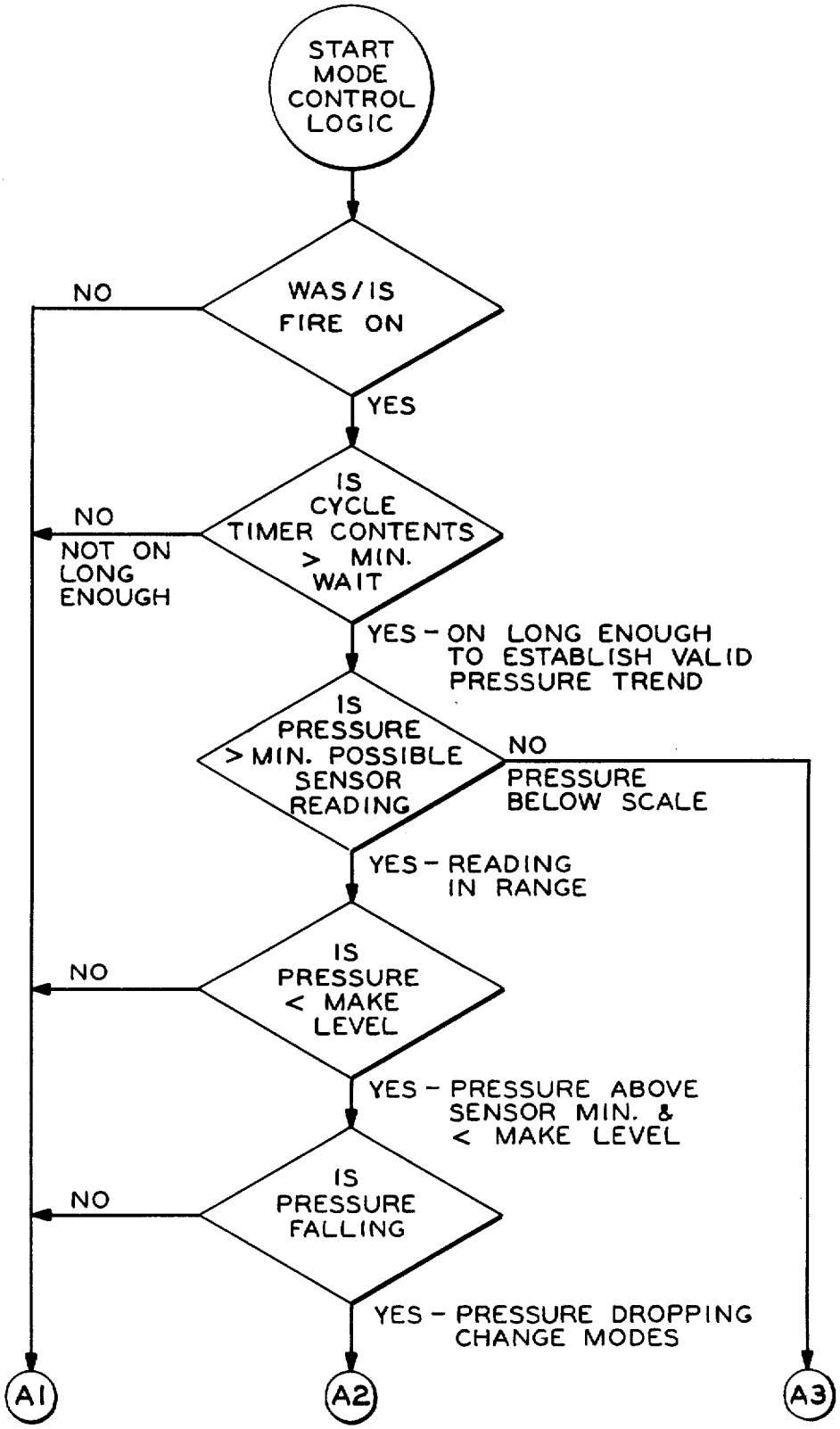
Figure 8B:
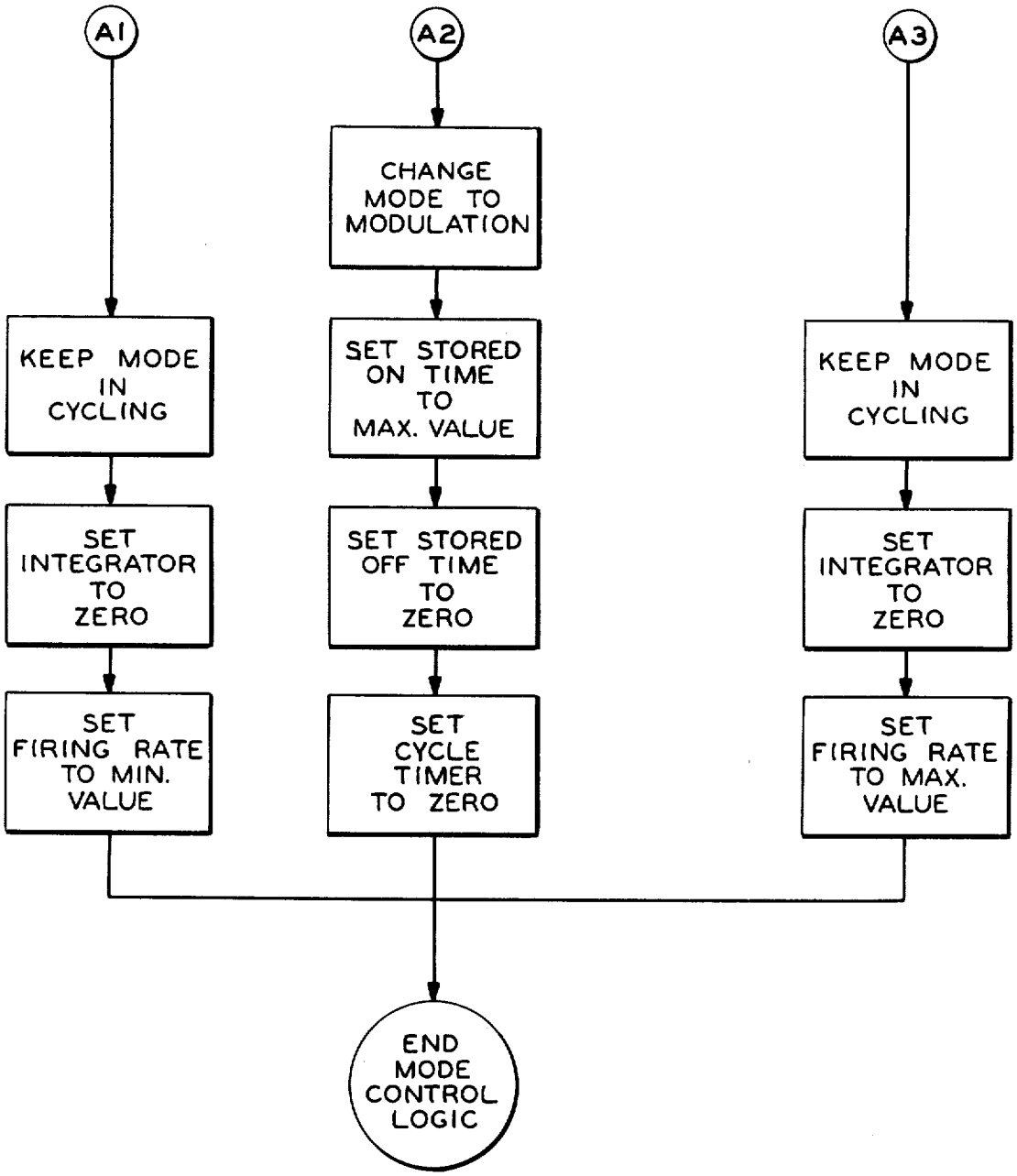

FIGS. 8A and 8B show the mode control logic associated with cycling. The purpose of this function block is to determine whether the system should switch from the cycling mode to the modulating mode. The system has a feedback from the sequencer means 71 which indicates whether the fire is on or off. The switch state of the fire feedback is read in each pass through the endless control loop. The value of the fire feedback flag is stored from the previous pass through the endless loop. If the fire switch indicates that the fire was off during the last or present pass through the endless control loop, then the control should remain in the cycling mode. In the cycling mode, the integrator output I of the integral action block is set to zero, and the firing rate command is set to its minimum value. If the fire is on and the cycle timer contents is less then the minimum value required to establish a reliable pressure trend, then the system should remain in the cycling mode until the timer is greater than the minimum value. If the fire is on, and it has been no longer than the time necessary to establish a pressure trend, then the proper mode can be determined by the pressure reading or its rate of change at 86. If the pressure is greater than the minimum possible sensor reading, the pressure trend would be meaningless as the sensor reading would be fixed at the lowest possible value. In these conditions, the mode remains in the cycling mode with the integrator set to zero. The difference in this situation is that the firing rate is set to the maximum value to bring the pressure as quickly as possible back into the sensor range. If the pressure is already within the sensor range, the pressure is compared with the make level. If the pressure is above the make level, the device remains in the cycling mode regardless of the pressure trend. If the pressure is less than the make level and the pressure is falling, it is necessary to release the control to the modulating mode. Upon release to modulation, the stored on time value is set to a maximum and the stored off time value is set to zero as is the contents of the cycle timer 100. If the pressure trend indicates rising pressure, there is no need to leave the cycling mode as the low firing rate will eventually satisfy the load.

In the cycling mode the firing rate command is normally fixed to the minimum value. The only exception to this rule is if the pressure is below the minimum possible sensor reading, and the fire has been on for longer than the minimum time (typically 1-2 minutes) needed to establish a valid pressure trend. Under these conditions, the maximum firing rate is allowed. The maximum firing rate will always bring the pressure back into the sensor range with the mode in the cycling state. Once the pressure rises above the bottom of the sensor range, the firing rate is driven back to its minimum value. If the pressure falls as a result of this action, the sensor can detect the downward pressure trend as the pressure has been driven back into the sensor range. The downward pressure trend is interpreted as a need to switch to the modulating mode, which allows steady higher firing rates. It is hoped that a sensor with adequate range can always be utilized to prevent the pressure from ever falling below the bottom of the scale. This extra mode of operation is a backup condition, should such a sensor prove not to be available.

Figure 9:
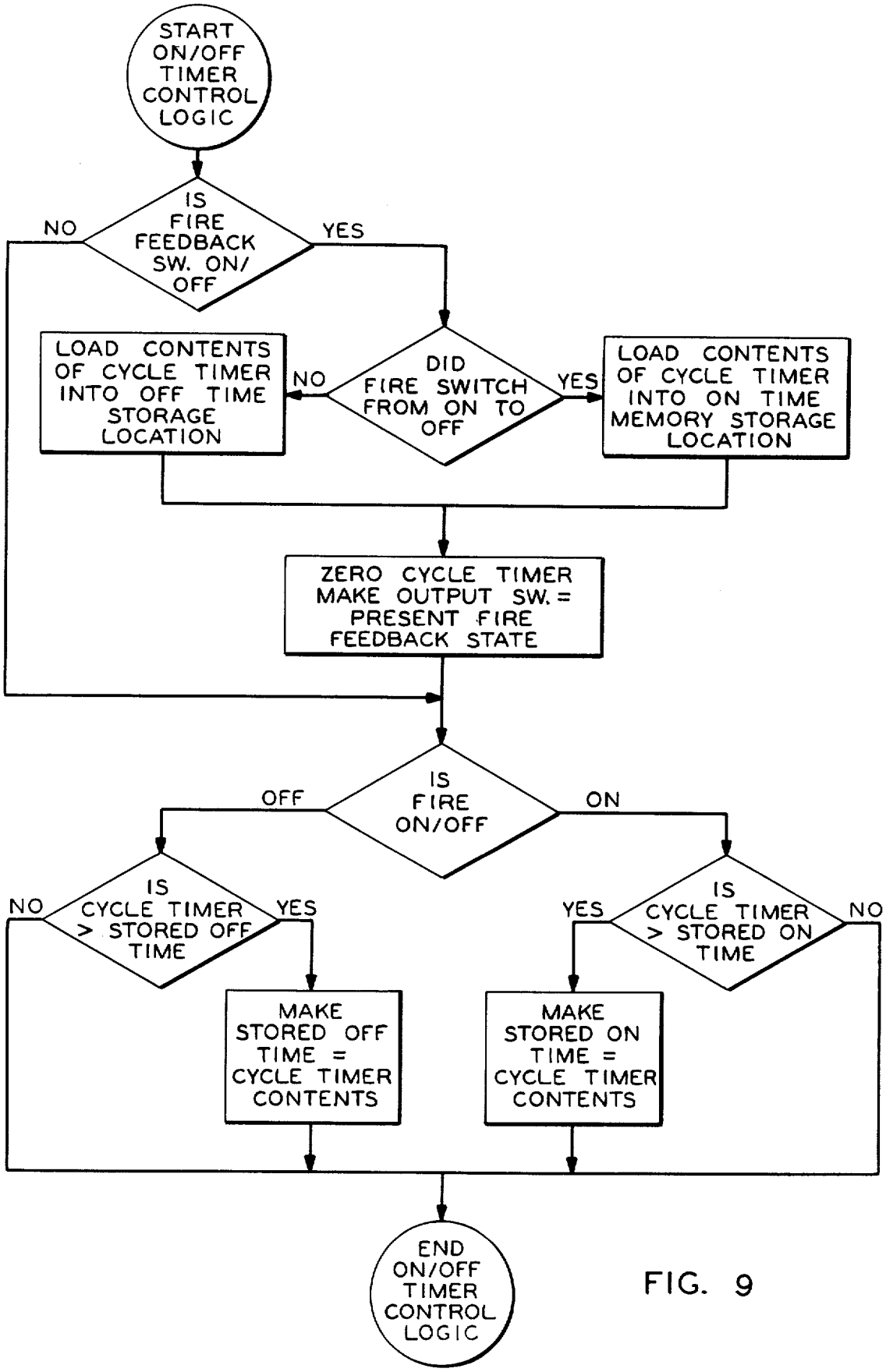

The flow chart of FIG. 9 shows how the on/off interval timers are controlled. The cycle timer is used to time the interval between switching events; i.e., the cycle timer times the duration of firing during a firing cycle or the duration of the interval between firing cycles. The first decision block on FIG. 9 compares the present state of the fire feedback flag with the state of the flag saved from the last pass through the endless control loop. If the feedback flag has changed state, a switching event has occurred between this and the previous pass through the control loop. If a switching event occurs (yes) the contents of the cycle timer is loaded into the appropriate on or off time memory location. If the switch state went from on to off (yes) the cycle timer is loaded into the on time storage location. If the fire switched from off to on (no) the contents of the cycle timer is loaded into the off time storage location. After saving the cycle time interval in the appropriate location, the cycle timer is zeroed to begin timing the next interval. If the switch state had not changed this storage update does not occur. Thus, the first half of the flow chart of FIG. 9 causes the stored on and off times to be set equal to the cycle timer value whenever the firing status changes state. At switching events, the cycle timer is set to zero. There is another logical condition under which the stored on or off time value is updated to the cycle timer value, i.e., whenever the current on or off cycle is longer than the previous on or off cycle was. The on and off times are used to compute the apparent load on the boiler. If the loads are rising for example, each successive on time interval will be longer than the previous one. As soon as the on time in the cycle timer gets longer than the stored previous value we can correctly deduce that the loads have risen. Thus, the stored on time is updated continuously after the cycle timer gets greater than the stored value. While the cycle timer contents are less than the previous stored value, it cannot be determined that the loads have changed. It would be inappropriate to update the previous cycle time with a shorter duration as the switching event has not yet occurred. It is not possible to predict that the present cycle interval will be shorter than the previous timed interval until the switching occurs. Thus, the second half of the flow chart in FIG. 9 determines first whether the fire is on or off. If the fire is on, the cycle timer is compared with the previously stored on time. If it is greater than the stored value, the stored on time is set equal to the cycle timer contents. If it is less, the stored time remains unchanged. If the fire is off the cycle timer is compared with the stored off time. If it is greater than the off time the stored value is updated to the current timer value. If the time is less than the stored value, the stored value remains unchanged.

This completes the description of the subfunction flow charts associated with the cycling mode of the control function. As shown in the overall system flow chart of FIG. 5, the on/off timer logic block completes the cycling mode path. The control logic then updates the firing rate and switch state command outputs previously calculated. The cycle timer is incremented by the cycle time and the endless control loop begins again. The next subject is the detailed description of the function blocks associated with the modulating control path of the overall system flow chart.

Figure 10:
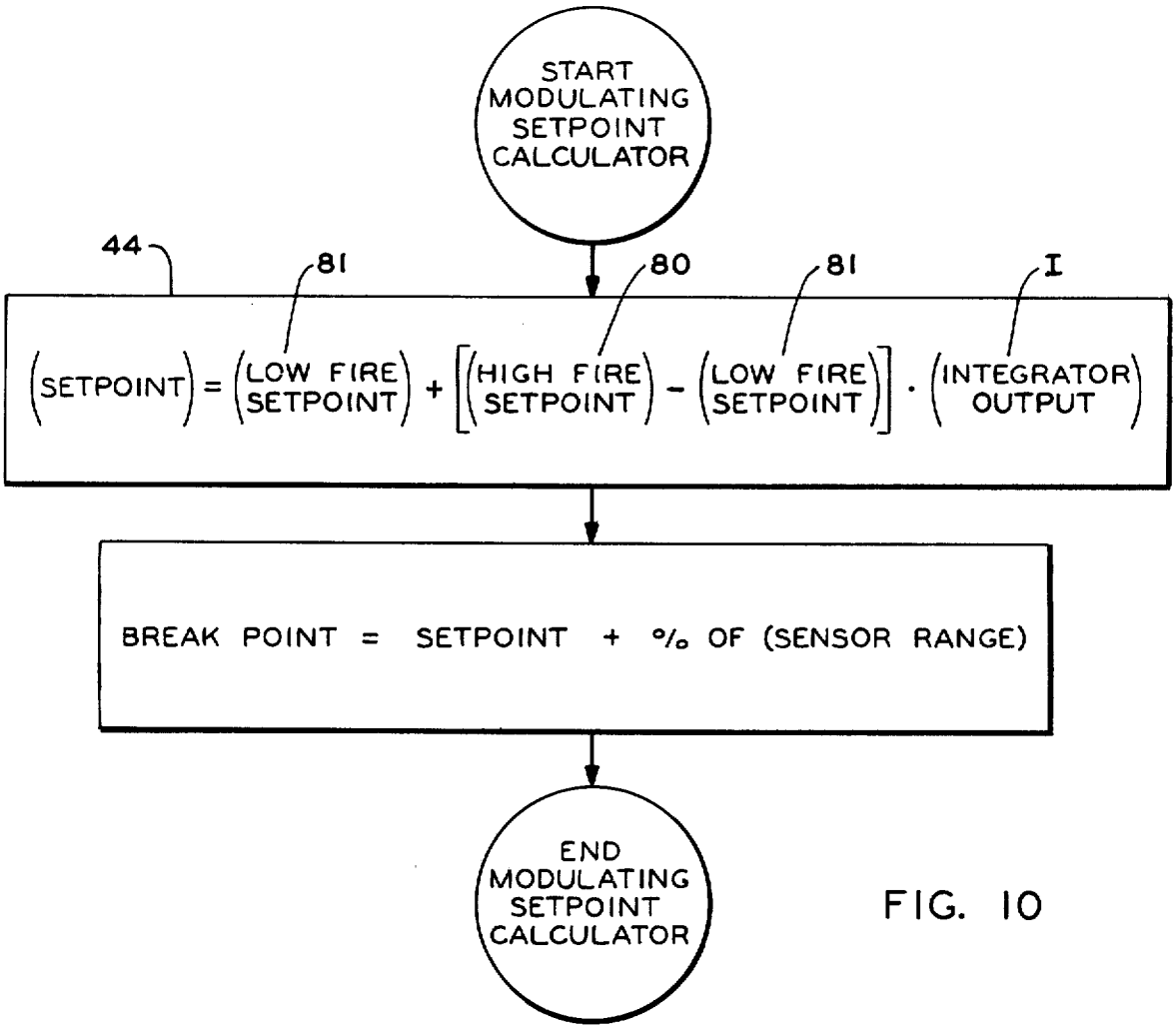
Figure 14:
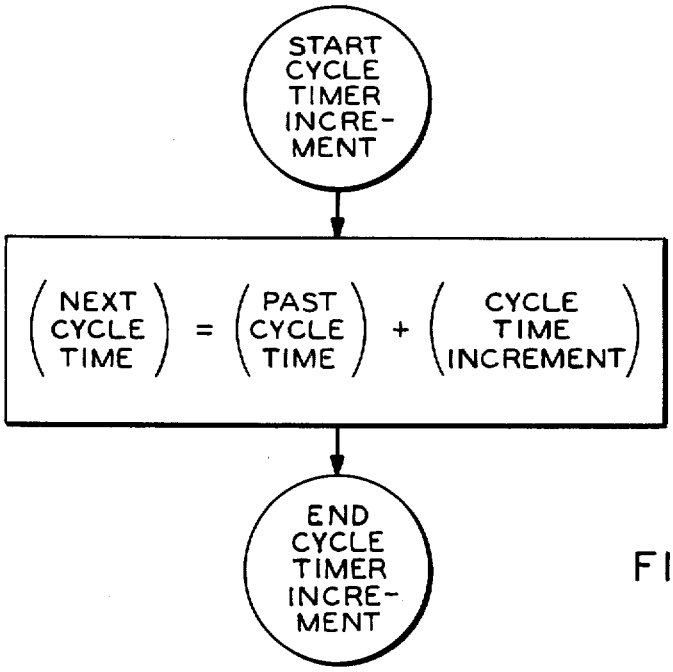

The first function block on the modulating control path shown on the overall system flow chart of FIG. 5 is the modulating setpoint and break level computation. FIG. 10 is the detailed flow chart of the modulating setpoint computation. The setpoint means 44, under modulating control, is equal to the setpoint associated with low fire loads plus the difference between the setpoint associated with high fire loads minus the setpoint associated with low fire loads all multiplied by the integral action output. The low fire setpoint and high fire setpoint are manual inputs or are derived from manual inputs. The integral action output is an internal controller state which is continuously updated during the controller operation. When the integrator output is zero, the loads are at the low fire setpoint and hence the proper internal setpoint is reset to that value. When the integrator output is 1 (its maximum value) the setpoint formula yields the high fire setpoint. The integrator output at its maximum value indicates maximum load condition. In this way, the internal setpoint varies continuously from the low fire to the high fire setpoint as the loads vary over the modulating range.

In FIG. 10, the break point in modulation is simply the modulating setpoint plus a fixed percentage of the sensor range. The fixed percentage is a percent of the sensor range in this example. Since the boiler is already firing in the modulating mode, a make point associated with modulating control is not required. The break point formula could have employed the manual make to break differential for determination of the break point. It was determined that abrupt load changes would cause the pressure to vary from setpoint during modulating control by an amount greater than the normal make to break differential. Thus, to enhance stability and prevent unnecessary cycling, the manual input is overridden by a fixed percentage of the sensor range. This higher break point will only be utilized when the loads fall below the throttling range of the burner for a sustained period requiring burner shutdown. This happens perhaps daily during some seasons of the year, but no more frequently than that. Thus, this modification should be invisible to the user.

Figure 11:
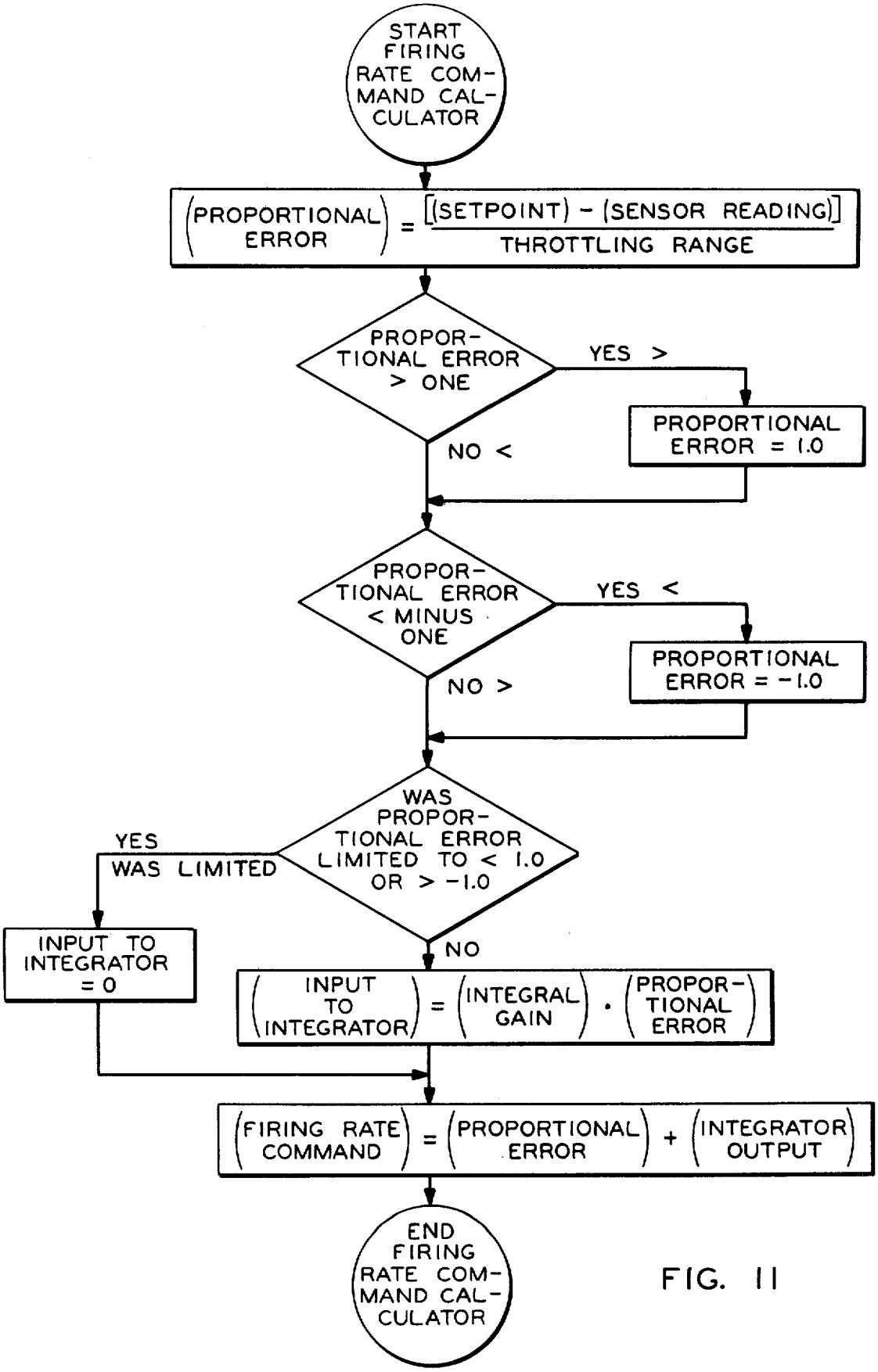

The next subfunction block in the system is the firing rate control block. The firing rate control flow chart is shown in FIG. 11. This function block computes the proportional error, the input to the integral action block, and finally the firing rate command associated with modulating control. The proportional error is simply the setpoint value minus the current sensor reading all divided by the throttling range. The inverse throttling range is simply the proportional gain. The logic blocks following the proportional error computation limit the proportional error to the range from $-1$ to $+1$. The magnitude 1 is associated with the highest possible firing rate. Magnitude zero is associated with the low fire firing rate. The proportional error is added to the integral error to produce the net firing rate command. Since the integral output can range as high as plus 1, it is desirable to allow the proportional gain to range as low as $-1$ to achieve a net firing rate command of zero, when necessary under dynamic load changes.

The proportional error signal input to the integrator associated with the integral action is normally the integral gain multiplied by the proportional error. If the proportional error is outside its allowed range before the limiting functions, a dramatic load change event must have occurred. Under these conditions, it is not desirable to allow the integrator to "wind up" to a large value during the transient period. Thus, the integrator input is set to zero when the proportional error is outside its normal range.

The firing rate command is set equal to the proportional error plus the integral output. The firing rate command is past out of the control computation and is converted to the appropriate analog signal for driving the actuators. The integrator output is limited to the range from zero to plus 1. Thus, under some conditions the sum of the proportional error plus integral output may be greater than the highest firing rate command possible or less than the lowest firing rate command possible. The digital to analog conversion must affect this limit function in such a way that the actuators are actually driven to either extreme position when the command is outside the limit.

Figure 12:
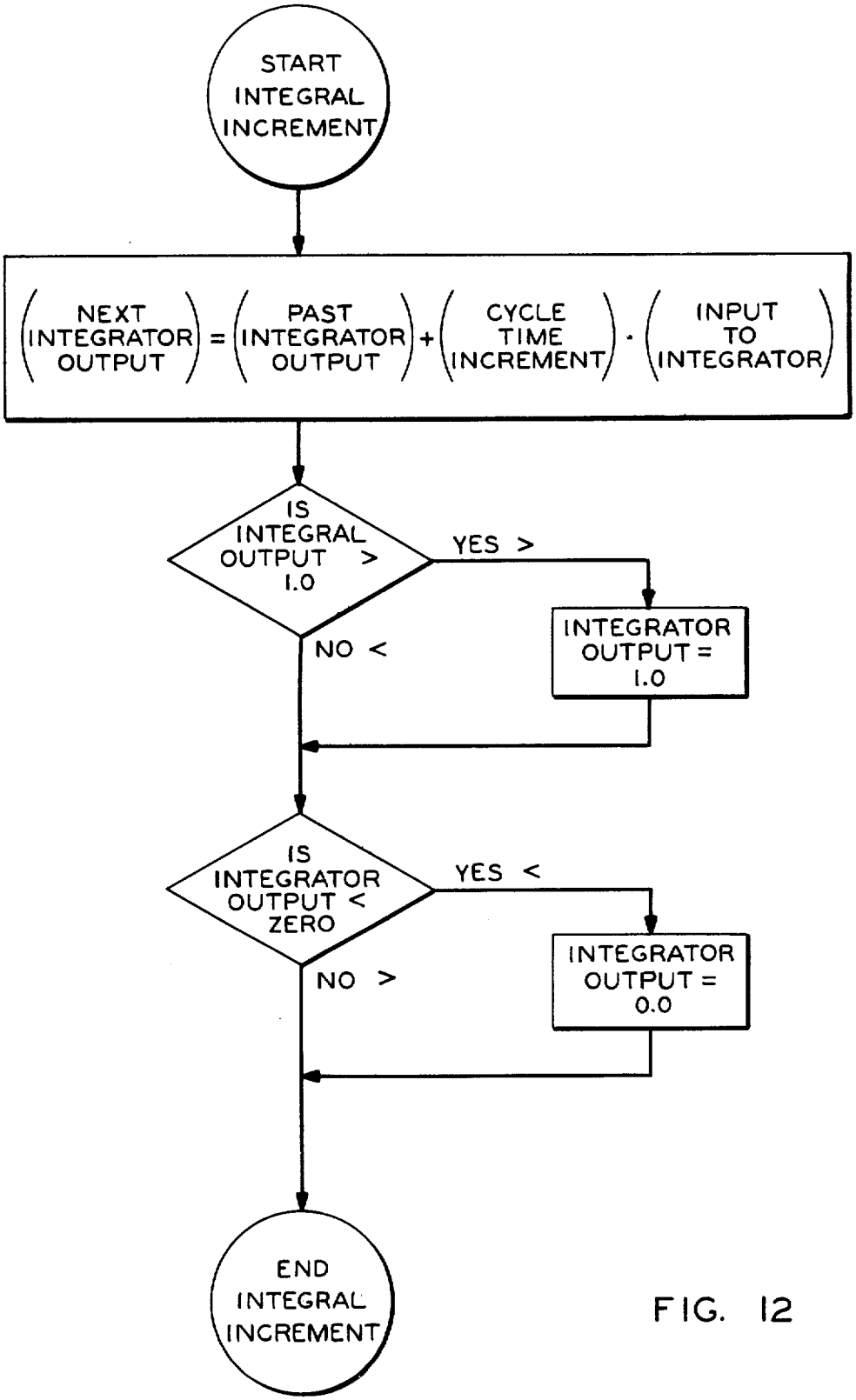

The function block associated with the numerical integration of the integral action is shown in FIG. 12. The next integral action integrator output is equal to the past output plus the input to the integrator as calculated previously multiplied by the cycle time increment. The cycle time increment is the time required for the control algorithm to execute one pass through the endless control loop. After each increment of the integral action output, the output is limited to within the range from zero to plus 1.

Figure 13:
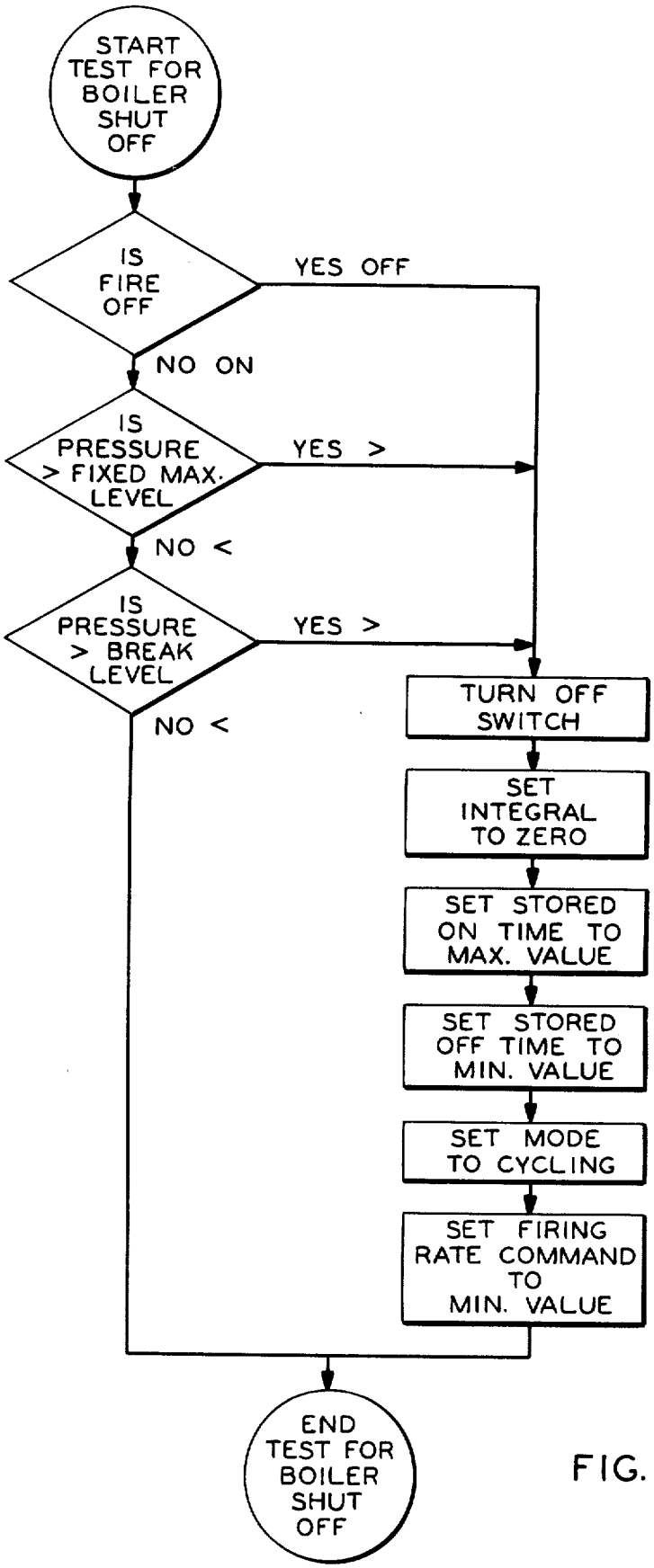

In the modulating mode, it is necessary to test for boiler shutdown. FIG. 13 shows the flow chart associated with the boiler shutdown test. If the boiler is shut off in the modulation mode, the control mode must be switched to the cycling mode and the internal memory states must be updated to the appropriate values. The first logical proposition in the test for boiler shutdown is to interrogate the flame on/off feedback signal from the sequencer means 71. If the flame has shut off, the internal logical state of the control algorithm must be made to coincide with this outside event. There are many safety interlock controls which can shut the boiler down for reasons other than steam pressure. If one of these other shutdown events occurs, the system must conform with that event. If the flame is still on, the next question is has the pressure risen above the fixed maximum allowable level. This fixed maximum allowed pressure level may be the upper limit of the pressure sensor range. If the pressure is above that level, the boiler is shut down. If the pressure is not above the maximum level, it may be above the current break level associated with the current setpoint. If the pressure has risen above the current break level, the shutdown sequence begins. If the pressure is below the break level, the system remains on in the modulating mode. The shutdown sequence turns the output switch off, sets the integral action output to zero, sets the stored on time to a maximum value, sets the stored off time to its minimum value, and finally sets the mode back to the cycling state. The firing rate command is also set to its minimum value appropriate to cycling. In this way, when the control begins cyclic operation, the long on time causes the setpoint reset subfunction in the cycling mode to command a setpoint equal to the low fire setpoint value. Thus, in the case of a gradual drop in load, the modulating control will reset the setpoint means 44 down to the low fire value and cycling operation will begin from that setpoint level. This ensures a "bumpless" transition from one mode to another.

This completes the function blocks associated with modulating control. At this point, the control algorithm outputs the firing rate and switch state to the actuators. In a microprocessor-based device, the algorithm of FIG. 14 will increment the cycle timer by the cycle time increment and enter a wait loop to wait until the specified cycle time increment is complete. Upon completion of the wait, the endless loop begins again. The cycle timer is incremented by the flow chart shown in FIG. 14. The cycle timer is incremented each pass through the control loop whether it is in the modulating or cycling mode. The next cycle timer value is equal to the past cycle time value plus the fixed cycle time increment.

The compete block diagram of a prior art device, a block diagram of the present invention, and a complete set of flow charts have been disclosed to explain the present invention. The description of the present invention primarily has been predicated on the use of a microprocessor for accomplishing the implementation of the invention. There is no reason, whatsoever, that the invention could not be readily accomplished by the use of dedicated wiring, relays, amplifiers, comparators, and more conventional electronics.

The present invention has been disclosed in one form and has been specifically described as applicable to a boiler for heating water into steam or merely the heating of water for the working fluid. The working fluid could be air, or a coolant used in refrigeration systems. The disclosure based on a boiler and steam was used as the simplest mode of explaining the present invention and also provides one of the best modes for the application of this invention to actual control equipment. Since the present invention can be modified in a number of ways specifically described within the description of the invention, the applicant wishes to be limited in the scope of his invention solely by the scope of the appended claims.

The embodiments of the invention in which an exclusive property or right is claimed are defined as follows:

1. A condition control system adapted to control a system for modifying a working fluid by controlling the transfer of energy to and from said working fluid at varying rates including a fixed lower on rate, a fixed upper rate, and a modulating rate between said two fixed rates, including: condition sensor means including output means responsive to the condition of said working fluid; setpoint means having at least two operating modes and including adjustable input means to set a level of operation for said system; said setpoint means including system responsive input means, and having output means which is dependent upon said adjustable input means and said system responsive input means to determine which of said operating modes is provided to control said setpoint output means; said setpoint output means being combined with said condition sensor output means to provide a preliminary error signal; off-on error detection means connected to receive said preliminary error signal and having output means providing an off-on output control signal; condition control sequencer means connected to control said system between an off state and said fixed upper rate to modify said working fluid with said on-off error detection output means controlling said sequencer means between said off state and said lower on rate; error signal processing means connected to said preliminary error signal and having error signal output means and further having integrated output signal means; combining means connected to said error signal output means and to said integrated output signal means to provide a sequencer command output signal capable of operating said sequencer means from said lower on state to said fixed upper rate; said integrated output signal means further connected to said setpoint means to affect a first of said operating modes of said setpoint means; responsive means having input means connected to said condition sensor output means and having further input means responsive to said on-off error detector means; said load responsive means having switched output means that acts as a limit for said system; said switched output means connected to said setpoint system responsive input means to select one of said operating modes; gate means controlled by said switched output means to in turn control the connection of said sequencer command output signal means to said sequencer means; and cycle timer means having an input responsive to said sequencer means wherein said off-on error detection means provides the operating time of said system, and an output connected to said setpoint means to determine an operating level of said setpoint means to affect a second of said modes of said setpoint means operation.

2. A condition control system as described in claim 1 wherein said load responsive means includes means to differentiate an output of said condition sensor means to establish the sign of the rate of change of condition in said working fluid.

3. A condition control system as described in claim 2 wherein said load responsive means includes time delay means to delay the effect of said load responsive means to allow said system to become stable in its need to modify the transfer of energy to or from said working fluid.

4. A condition control system as described in claim 3 wherein said error signal processing means includes gain means and signal limiting means connected to said preliminary error signal to provide a limited error signal at said error signal output means; and integrator means having an input connected to said error signal means and having an integrated output signal combined with said error signal output means at said combining means.

5. A condition control system as described in claim 4 wherein said combining means is a summing means.

6. A condition control system as described in claim 5 wherein said condition sensor means is pressure sensor means and said system for modifying a working fluid is a boiler wherein water is the working fluid to which the transfer of energy is controlled.

7. A condition control system as described in claim 6 wherein said setpoint means operating modes are a low fire mode and a modulating fire mode for a burner for said boiler.

8. A condition control system as described in claim 7 wherein said cycle timer means measures an on time for the sequencer means versus the sum of said on time and an off time for said sequencer means to generate a percent on time for said system; said percent on time being connected as an input to said setpoint means to determine said operating level of said setpoint means in its second mode of operation.

9. A condition control system as described in claim 8 wherein said integrated output signal means is connected as an input to said setpoint means to determine said operating level of said setpoint means in its first mode of operation.

10. A condition control system as described in claim 9 wherein said condition control system further includes make to break differential means having two levels of differential with said make to break differential means having an output connected to control said off-on error detector means, and having an input responsive to said load responsive switched output means.

11. A condition control system as described in claim 1 wherein said condition control system further includes a make to break differential means having two levels of differential with said make to break differential means having an output connected to control said off-on error detector means, and having an input responsive to said load responsive switched output means.

12. A condition control system as described in claim 10 wherein said adjustable input means includes a lower on rate adjustable input, an upper rate adjustable rate, and an off rate adjustable input.

13. A condition control system as described in claim 12 wherein said error signal processing means gain is an adjustable gain to adjust the level of said preliminary error signal; and said integrator means includes adjustable gain means.

14. A condition control system as described in claim 1 wherein said adjustable input means includes a lower on rate adjustable input, an upper rate adjustable input, and an off rate adjustable input.

15. A condition control system as described in claim 14 wherein said error signal processing means gain is an adjustable gain to adjust the level of said preliminary error signal; and said integrator means includes adjustable gain means.

16. A condition control system as described in claim 5 wherein said condition sensor means is temperature sensor means and said system for modifying a working fluid is a boiler wherein water is the working fluid to which the transfer of energy is controlled.

17. A condition control system as described in claim 16 wherein said setpoint means operating modes are a low fire mode and a modulating fire mode for a burner for said boiler.

18. A condition control system as described in claim 17 wherein said cycle timer means measures an on time for the sequencer means versus the sum of said on time and an off time for said sequencer means to generate a percent on time for said system; said percent on time being connected as an input to said setpoint means to determine said operating level of said setpoint means in its second mode of operation.

19. A condition control system as described in claim 18 wherein said integrated output signal means is connected as an input to said setpoint means to determine said operating level of said setpoint means in its first mode of operation.

20. A condition control system as described in claim 19 wherein said condition control system further includes make to break differential means having two levels of differential with said make to break differential means having an output connected to control said off-on error detector means and having an input responsive to said load responsive switched output means.

* * * * *